United States Patent [19]

Wieschel

[11] 4,071,205

[45] Jan. 31, 1978

[54] SPOOLING DRUM INCLUDING STEPPED FLANGES

[75] Inventor: John E. Wieschel, Hartland, Wis.

[73] Assignee: Harnischfeger Corporation, West Milwaukee, Wis.

[21] Appl. No.: 718,116

[22] Filed: Aug. 27, 1976

[51] Int. Cl.[2] ..... B65H 75/14; B65H 75/34

[52] U.S. Cl. ..... 242/117

[58] Field of Search ..... 242/117, 54 R

[56] References Cited

U.S. PATENT DOCUMENTS

| | | | |
|---|---|---|---|
| 1,822,422 | 9/1931 | Richardson | 242/117 |
| 2,420,050 | 5/1947 | Maude | 242/117 |
| 2,892,598 | 6/1959 | Dudley | 242/117 |
| 3,391,443 | 7/1968 | Le Bus, Sr. | 242/117 X |

*Primary Examiner*—George F. Mautz

*Attorney, Agent, or Firm*—James E. Nilles

[57] ABSTRACT

A spooling drum for spooling multiple layers of wire rope or cable and having a structure preventing localized wear or crushing of the wire rope, the spooling drum including a cylindrical core and a stepped flange at each end of the core. The stepped flanges include one or more steps which support a riser having a tapered end which functions to receive the end wind of the wire rope as the drum rotates and to lift the rope to the next higher level of wind to thereby facilitate formation of a subsequent layer of wound wire rope. The risers supported by the steps of the flanges function to prevent wear of the cable caused by potential pinching of the cable against the flanges, and the steps facilitate the use of risers for any number of layers and avoid interference by the risers with orderly layered winding or spooling operations.

3 Claims, 9 Drawing Figures

SPOOLING DRUM INCLUDING STEPPED FLANGES

BACKGROUND OF THE INVENTION

The present invention relates to hoisting apparatus and more particularly to an improved hoist drum or spool for receiving wire rope and the like and which prevents crushing and undue wear of the wire rope.

Conventional hoist drums are shown for example in the LeBus patents, U.S. Pat. No. 3,150,844, issued Sept. 29, 1964, and in U.S. Pat. No. 3,391,879, issued July 9, 1968. Such hoist drums generally include a cylindrical drum and flanges at each end and are intended to support at least several layers of evenly wound wire rope. The wire rope is wound around the drums and progresses in a circumferential and longitudinal path from one end of the drum to the other end to form discrete layers. The first layer of the wire rope on the drum extends from the inner face of one drum flange member to the inner face of a drum flange member at the opposite end of the drum. As the wire rope reaches the other flange, it forms a second layer having a reverse helical wrap and the coils of the second layer lie in the grooves formed by the coils of the first layer. Each succeeding layer of wire rope is reversed in a similar manner to provide for the winding of the wire rope on the spool. During the spooling process of each layer, as the wire rope is being wound and approaches one of the flanges, the gap or space between an adjacent coil of the wire rope and the flange eventually becomes less than the thickness of the wire rope. The wire rope is thus pinched therebetween and this pinching effect forces the wire rope outwardly wherein continued winding causes the wire rope to form a new layer whereupon the wire rope can begin to traverse the length of the drum in the opposite direction toward the other flange.

Due to the pinching action of the wire rope adjacent to the drum flange, that portion of the wire rope being pinched is subjected to both crushing and scrubbing action and to greater wear than the remainder of the rope. This problem is increased in the event that the hoist drum is used such that that portion of the rope subjected to pinching is played out and then rewound frequently, thus causing increased crushing, scrubbing, and wear of a localized portion of the rope. The pinching effect referred to above also has the undesirable effect of subjecting the drum flange to localized wear forces frequently causing premature wear or distortion of the drum flanges and costly maintenance or replacement.

SUMMARY OF THE INVENTION

The present invention provides an improved hoist drum which provides a means for preventing pinching of the cable or wire rope against the flange at each level of transition without interfering with orderly layered winding and thereby substantially reducing the scrubbing and wear of the wire rope and preventing wear of the flanges.

The hoist drum or spool of the invention generally includes a cylindrical core and a flange secured to each end of the core, each flange having at least one step arranged concentrically with respect to the core, the steps each defining a ledge for providing support for an end wind of the wire rope. The steps each support an elongated riser which follows the contour of the ledge and which is positioned adjacent to the inner surface of the flange. The elongated riser includes a tapered end portion which is positioned such that it is received beneath that portion of the end wind where pinching would otherwise occur and functions to provide means to lift the end wind of the layer to the next level of wind and thereby preclude pinching of the rope between the flange and an adjacent wind. The risers are particularly circumferentially positioned such that as the drum rotates, they function to lift the wire rope to a succeeding layer immediately before it would otherwise be subjected to pinching. The elongated riser also includes a support filler which is an integral continuation of the tapered end of the riser and which functions to support and to properly position the end wind as it forms the first wind of the new layer.

In order to facilitate proper alignment of the winds with the risers and steps such that the end wind will be supported by the riser, it may be advantageous to provide the surface of the drum with the LeBus-type grooves, commonly known in the art and illustrated in the previously cited patents, because the grooving shown therein causes the rope to be consistently received against the flange at a particular circumferential location and thereby ensures that the riser will be properly aligned to lift the end wind to the next level of wind.

A principal advantage of the hoist drum construction is that the wire rope is not pinched between an adjacent wind and a flange, and as a result, the wire rope is not subjected to crushing, scrubbing, and wear as in the prior art mechanisms. Therefore, the wire rope need not comprise the special and very costly crush-resistant cable commonly in use. Furthermore, since localized wear on the wire rope is prevented, the machine employing the hoist drum is safer to operate since hidden cable damage is eliminated. Another substantial advantage of the hoist drum is that there is little if any wear of the flanges since the cable is not pinched against the flange. In order to maintain proper spooling of the wire rope, it is necessary that the dimensions between the spool drum flanges be accurately determined. With prior art apparatus wherein pinching of the cable caused wear of the flange, the wear was frequently sufficient to cause improper spooling of the cable.

Further advantages of the invention will be made clear in the following description of a preferred embodiment of the invention.

DESCRIPTION OF THE PREFERRED EMBODIMENT

Figure 1:
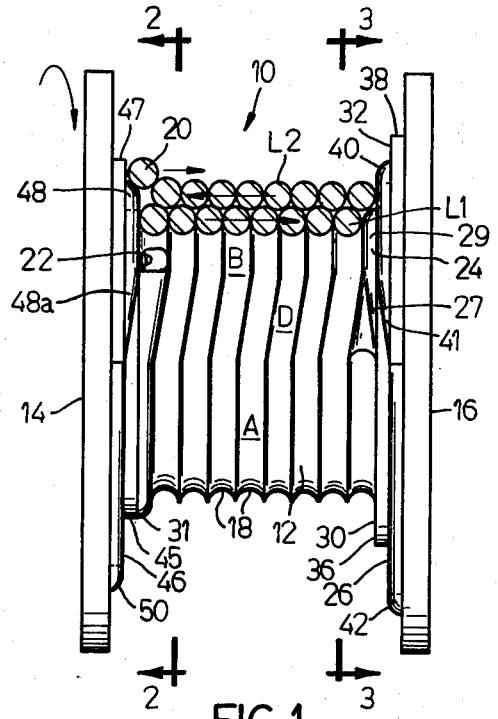
FIG. 1 is a plan view of a spooling drum of the present invention.
Figure 2:
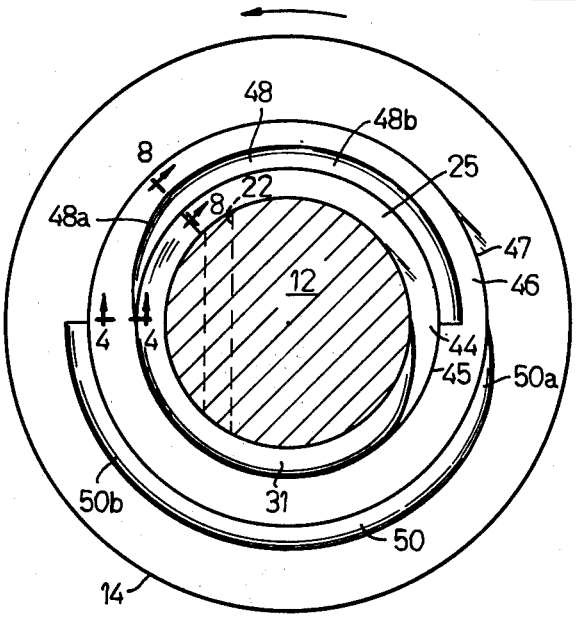
FIG. 2 is a sectional view taken along line 2—2 in FIG. 1.

The spooling drum 10 shown in FIG. 1 generally comprises a cylindrical core member 12 and a pair of opposed end flange members 14 and 16 secured thereto. The outer periphery of the cylindrical core 12 is provided with wire rope receiving grooves 18 having a configuration such as that of the grooves in U.S. Pat. No. 3,150,844, issued Sept. 29, 1964 to LeBus. The particular grooving configuration shown in the drawings and described thereinafter is an example of a commonly used mode but it will be readily apparent that the core 12 of the spooling drum of the invention could also be provided with a smooth wire rope supporting surface or with grooves having a helical configuration. Referring to FIGS. 1 and 2, one end of a wire rope 20, which is to be spooled around the drum, is fixed in a conventional manner within a bore 22, and is wound around the drum supported in the grooves 18 and progressing both circumferentially and longitudinally from the flange 14 to the flange 16. The wound wire rope 22 thus forms a layer $L_1$ extending between the flanges 14 and 16 and comprising a plurality of winds.

Figure 9:
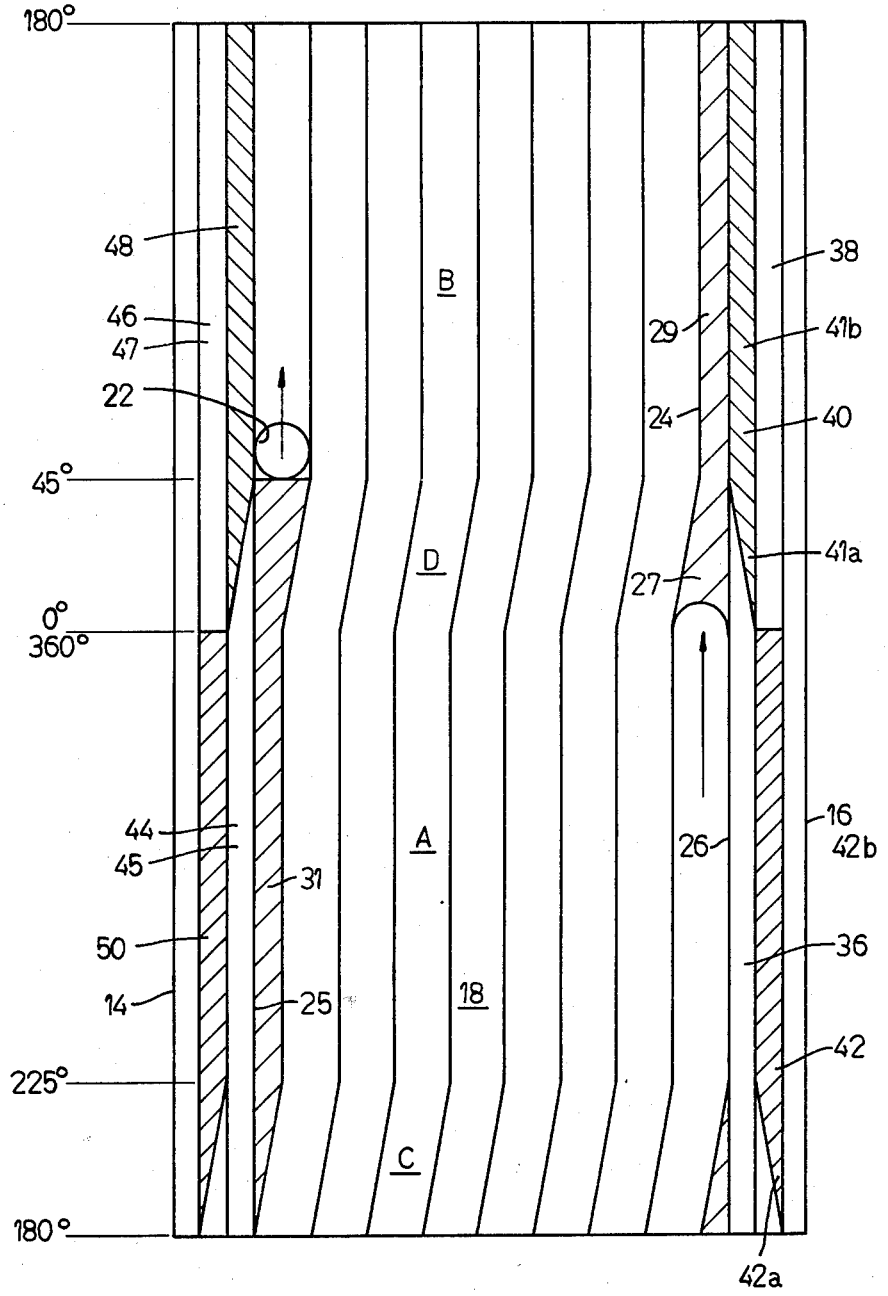
FIG. 9 is a schematic development of the groove pattern of the spooling drum and illustrating the relative positions of the risers with respect to the groove pattern.

The pattern formed by grooves 18 illustrated in FIG. 1 is shown schematically in the development view of FIG. 9 as extending around the circumference of the core 12 in two separate sets of parallel circumferential groove portions A and B, the sets of groove portions A and B being separated by two different sets of helical groove portions C and D disposed on opposite sides of the drum and providing two separate control or pitch areas, respectively. When the cable is being wound on such a drum and is received in the circumferential groove portions A or B, the cable is wound around the drum in a plane perpendicular to the longitudinal axis of the drum, and only when the cable is received in the helical groove portions C and D does it move longitudinally toward the flange 16. The helical groove portions C and D each comprise an arcuate segment of approximately 45° of the circumference of the drum 10.

Figure 3:
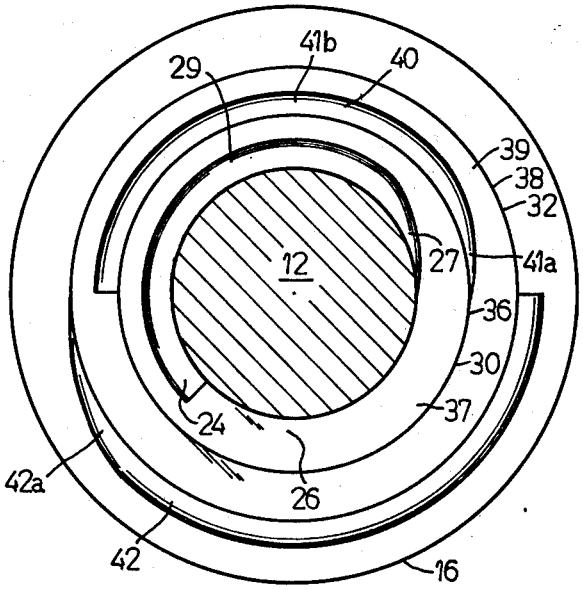
FIG. 3 is a sectional view taken along line 3—3 in FIG. 1.
Figure 8:
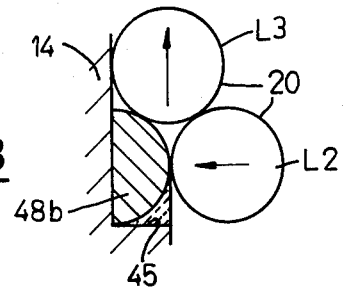
FIGS. 4–8 are crossectional views taken generally along line 4—4 in FIG. 2 illustrating sequentially the effect of the tapered end portion of the riser in lifting an end wind to form the first wind of a next level of wind as the drum rotates through an arc of approximately 45°.
Figure 7:
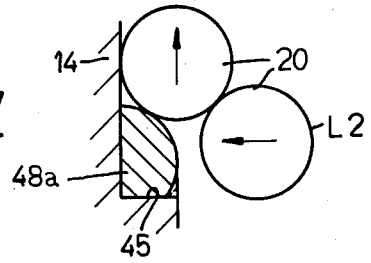
Figure 6:
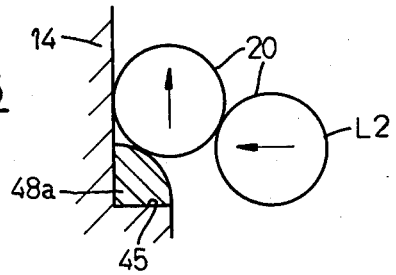
Figure 5:
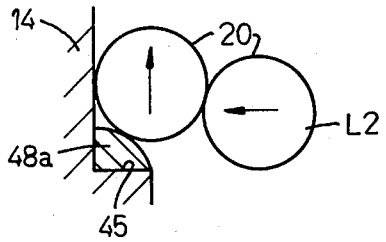

Referring again to FIG. 1 and to FIG. 3, the end of the core member 12 adjacent the end flange 16 supports an elongated riser 24 which is disposed adjacent to the inner surface 26 of the flange 16 and at the juncture of the inner surface 26 with the core 12. The elongated riser 24 is provided with a leading end portion 27 positioned in circumferential alignment with the helical groove portion D and an elongated support filler 29 integral with the end portion 27 and in circumferential alignment with the circumferential groove portion B. The elongated riser 24 may be welded or otherwise integrally joined to the flanges 14 or 16 and the core 12, or may be removably secured to these elements of the spooling drum 10.

In operation, the wire rope 20 to be wound on the drum 10 is secured at one end within the bore 22 adjacent flange 14 and as the drum rotates in the direction of the arrow shown in FIGS. 1 and 2, the wire rope 20 is wound around the periphery of the core 12 and is disposed in the wire rope receiving groove 18. As the drum continues to rotate, the winds of the wire rope 20 move longitudinally along the length of the core 12 toward the flange 16. As the winds of the wire rope 20 approach the flange 16 the wire rope 20 is received in the groove portion D immediately adjacent the flange 16, and the tapered leading end portion 27 of the end filler 24 is received beneath the wire rope in such a manner that as the drum continues to rotate the end portion 27 raises the wire rope to the next level of wind to form the first wind of the second layer $L_2$. The size and the configuration of the end portion 27 of the elongated riser 24 is particularly provided such that the end wind is supported in such a manner that rather than being crushed between the adjacent wind of the wire rope 20 and flange 16, the wire rope is lifted to the next level of wind $L_2$ without unnecessary wear, crushing, or scrubbing. As the drum 10 continues to rotate and the wire rope 20 is received along the groove portion B, the wire rope is received in adjacent relationship against the inner surface 26 of the flange 16. As the drum rotates further, the cable will be received adjacent the groove portion C wherein the wire rope 20 will cross over the last wind of the first layer $L_1$ to begin forming a second layer of wind $L_2$ each wind of the second layer of wind being supported between winds of the first level $L_1$, and wherein the cable 20 will then progress circumferentially and longitudinally with a reverse helical wrap toward the flange 14 in the manner well known in the art.

The end of the core 12 adjacent to the flange 14 also supports an elongated end filler 31, received at the juncture of the core 12 and the inside surface 25 of the flange 14, and functional to provide support for the end wind of layer $L_2$ adjacent flange 14 and to fill in the gap around the core 12 adjacent the bore 22 from which the cable projects.

Stepped Annular Flanges

The annular flange 16 is shown as including a pair of steps 30 and 32 in its inner face 26, the steps 30 and 32 each being concentric with respect to the cylindrical core member 12, and including a circumferentially extending base or ledge 36 and 38, respectively, the ledges 36 and 38 each shown as having a width substantially equal to one-half the thickness of the wire rope 20. The steps 30 and 32 also each include a radially extending side wall 37 and 39, respectively. The steps 30 and 32 are arranged in such a manner that the difference between the radius of the outer step 32 and the inner step 30 is generally equal to the relative radial dimension defined by the radial thickness of two layers of wind of wire rope 20. Though the flange 16 is shown as including only the two steps 30 and 32, any number of steps could be provided depending upon the desired number of layers of wire rope 20 to be wound upon the drum 10. The base portions or ledges 36 and 38 are shown in FIGS. 1 and 3 as having elongated risers 40 ad 42, respectively, similar in function to the elongated riser 24 supported by the end of the core 12, and having a tapered ramp configuration such that the base portions or ledges 36 and 38 of the steps 30 and 32 each have a progressively increasing diameter for approximately 45° of their circumferential length. The risers 40 and 42 may be cast integrally with the flange 16 or may comprise separate structural elements secured to the flange 16 by welding, etc. Referring specifically to the elongated riser 40, it is shown as including a leading tapered end portion or ramp **41*a* positioned in circumferential alignment with the helical portion D of the groove 18 and having its leading edge aligned with the leading edge of the helical portion D. The taper of the leading tapered end portion 41*a* of the riser 40 is intended to be substantially parallel to the helical pattern of the portion D and to extend through an arc of approximately 45°. The elongated riser 40 also includes an elongated filler 41*b*** integral with the tapered end portion 41*a*, and extending through an arc of approximately 135° parallel to the groove portion B. The riser 42 is similar to riser 40 in configuration but it is arranged on the opposite side of the drum such that its leading tapered end portion 42*a* is positioned in circumferential alignment with the helical portion C of groove 18 and its elongated filler portion 42*b* is in alignment with the groove portion A.

The flange 14, like the flange 16, includes a pair of concentric steps 44 and 46 including base portions or ledges 45 and 47, respectively, the ledges having elongated risers 48 and 50, respectively. The steps 44 and 46 of the flange 14 and the steps 30 and 32 of flange 16 are arranged in staggered relationship because they are each intended to support an end wind of a different level of wind of the wire rope. For example, the radially inner step 44 of the flange 14 has a radius which is less than the radius of the step 30 of the flange 16 by a dimension generally equal to the thickness of one layer of the wire rope 20, and similarly, the radially outer step 46 of the flange 14 has a radius less than the radius of the step 32 of the flange 16 by a dimension equal to the thickness of one layer of wire rope 20. The riser 48 supported by the step 44 is substantially the same in structural configuration as the risers 40 and 42, having a leading tapered end portion 48*a* defining an arc of approximately 45° and an elongated filler portion 48*b* of approximately 135°. The riser 50 similarly includes a leading tapered end portion 50*a* and an elongated filler portion 50*b*. The leading tapered end portion 48*a* of the riser 48 is circumferentially aligned with the helical groove portion D and the leading tapered portion 50*a* of the riser 50 is aligned with the helical groove portion C.

Figure 4:
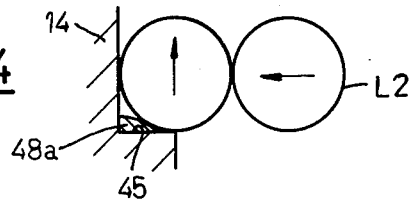

During the operation of the spooling drum 10, as the drum rotates and the second layer $L_2$ of the cable approaches the flange 14 and the last wind of that layer is received circumferentially adjacent the helical groove portion D, the wire rope will be received between the inside face 25 of the flange 14 and an adjacent wind. As the cable approaches this point, it will be received upon the leading tapered end portion 48*a* of the riser 48 as shown in FIG. 4 and as the drum continues to rotate will be lifted by the leading tapered portion of the riser 48 in the manner illustrated by the sequence shown in FIGS. 4–8 to the next level of wind $L_3$. As the drum continues to rotate, the elongated filler portion 48*b* of the riser 48 will be received beneath the wire rope 20 and will function to support the cable through th circumferential portion B and until the cable is received above the helical groove portion C wherein the cable crosses over and begins to progress circumferentially and longitudinally in a reverse direction toward the flange 16 and having a helical wrap pattern the same as that of layer $L_1$.

Riser 40 supported by the ledge 36 of the flange 16 functions in a like manner to receive the end wind of the layer $L_3$ of the wire rope as the end wind approaches flange 16 to raise the cable from the layer $L_3$ to the fourth layer $L_4$ (not shown) as the cable is wound sufficiently that the cable comes into contact with the flange 16. Similarly the elongated riser 50 supported by step 46 of flange 14 will function to raise the wire rope 20 from level $L_4$ to level $L_5$ (not shown) and the elongated riser 42 supported by step 32 of flange 16 will function to raise the wire rope from level $L_5$ to level $L_6$ (not shown).

Of course if the spooling drum 10 is intended to be used to support only three layers of wire rope or cable, only one of flange 14 needs to be provided with a stepped configuration and will only need one step 44. The other flange 16 can be provided with a conventional structure.

I claim:

1. A rotatable spooling drum for spooling multiple layers of cable and comprising:

a cylindrical core having a longitudinal axis and opposite ends and for supporting said multiple layers of cable therearound, each of said layers of cable including a plurality of winds of cable extending around and along the length of the core;

a pair of annular flanges secured to said opposite ends of said cylindrical core and extending radially outwardly from said cylindrical core, at least one of said flanges including a stepped inner face defining a plurality of ledges concentric to said cylindrical core and extending radially outwardly therefrom, each ledge adapted to support thereagainst an end wind of two of said layers of cable, each ledge having a thickness equal to half the diameter of said cable and the diametric distance between the circumferences of adjacent ledges being approximately equal to the radial thickness of at least two layers of cable, and a riser having a tapered ramp disposed along a portion of the circumference of each ledge and along the circumference of the end of said core nearest said one of said flanges, whereby as said cable is wound around said drum, an end wind of a layer is raised by said riser to a radially outward position to form a succeeding layer of cable.

2. A rotatable spooling drum as set forth in claim 1 wherein each of said pair of annular flanges is provided with a stepped inner face defining a plurality of said ledges and having said risers.

3. A rotatable spooling drum for spooling multiple layers of cable and comprising:

a cylindrical core having a longitudinal axis and opposite ends and for supporting said multiple layers of cable, each of said layers of cable including a plurality of winds of cable extending along the length of the core;

an annular flange secured to each of said opposite ends of said cylindrical core and extending radially outwardly from said cylindrical core, at least one of said annular flanges including a stepped inner face defining a plurality of ledges concentric to said cylindrical core and extending radially outwardly therefrom for supporting an end wind of said layers of cable, each of said ledges including an elongated riser extending circumferentially along at least a portion thereof for supporting at end wind and having a tapered ramp portion for receiving an end wind thereon whereby as said cable is wound around said drum an end wind is raised by said ramp portion to a radially outward position to form a succeeding layer of cable, each ledge having a thickness approximately equal to half the diameter of said cable, and the diametric distance between the circumferences of adjacent ledges being approximately equal to the radial thickness of at least two layers of cable.

* * * * *